US012006704B1

(12) United States Patent
Guevara et al.

(10) Patent No.: US 12,006,704 B1
(45) Date of Patent: Jun. 11, 2024

(54) CASING BEAD

(71) Applicants: Herman Guevara, Hollywood, FL (US); Sergio Hernández, Miami, FL (US)

(72) Inventors: Herman Guevara, Hollywood, FL (US); Sergio Hernández, Miami, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 17/359,605

(22) Filed: Jun. 27, 2021

Related U.S. Application Data

(60) Provisional application No. 63/045,357, filed on Jun. 29, 2020, provisional application No. 63/045,788, filed on Jun. 29, 2020.

(51) Int. Cl.
*E04F 21/00* (2006.01)
*E04F 13/06* (2006.01)

(52) U.S. Cl.
CPC ..... *E04F 21/0038* (2013.01); *E04F 13/06* (2013.01); *E04F 21/0053* (2013.01)

(58) Field of Classification Search
CPC ... E04F 21/0053; E04F 15/0038; E04F 13/06; E04F 2013/063; E04F 19/02; E04F 19/061; E06B 2001/624; E06B 1/62
See application file for complete search history.

(56) References Cited

U.S. PATENT DOCUMENTS

| | | | | |
|---|---|---|---|---|
| 4,538,380 | A * | 9/1985 | Colliander | E06B 7/2314 49/490.1 |
| 5,946,870 | A * | 9/1999 | Bifano | E04B 1/765 52/60 |
| 9,279,247 | B2 * | 3/2016 | Maziarz | E06B 1/04 |
| D761,971 | S | 7/2016 | Apanovich et al. | |
| D861,196 | S | 9/2019 | Apanovich et al. | |
| 10,494,818 | B2 * | 12/2019 | Maziarz | E06B 7/2303 |
| 2016/0340908 | A1 * | 11/2016 | Apanovich | E04F 21/02 |
| 2019/0136549 | A1 * | 5/2019 | Maziarz | E04F 19/061 |

FOREIGN PATENT DOCUMENTS

| | | | | |
|---|---|---|---|---|
| DE | 29620179 U1 * | 3/1998 | | E04F 13/06 |
| WO | WO-2007128402 A1 * | 11/2007 | | E04F 13/06 |

* cited by examiner

*Primary Examiner* — Theodore V Adamos
(74) *Attorney, Agent, or Firm* — IPCL Group PLC; Anthony Tacconi, Esq.

(57) ABSTRACT

A casing bead having an integrated moisture seal. The casing bead has a body including a perforated flange designed to receive stucco, stone veneer, or a similar finishing system and a bead wall where the finishing system terminates. The casing bead further includes a mounting arrangement having a mounting channel disposed to receive a t-shaped rail. A moisture seal in the form of a circular rubber gasket colored red and having a t-shaped rail is removably secured within the mounting channel. The rubber gasket further includes a tail structure projection outward from the gasket for improved water and moisture resistance. The casing bead also includes a water dam having a water removal channel to facilitate the removal of any water and moisture which has penetrated the caulk or other sealant which has been used to cover the area around the moisture seal.

1 Claim, 3 Drawing Sheets

CASING BEAD

CROSS-REFERENCE TO RELATED APPLICATIONS

This application claims the benefit of the filing date of U.S. Provisional Patent Application Ser. No. 63/045,788 filed on Jun. 29, 2020 and U.S. Provisional Patent Application Ser. No. 63/045,357 also filed on Jun. 29, 2020.

FIELD OF THE INVENTION

This invention relates to construction materials for walls of buildings, and in particular, to a casing bead for use with stucco and stone veneer applications.

BACKGROUND OF THE INVENTION

A variety of exterior wall systems are used in the construction industry. Stucco and stone veneer are two such systems frequently applied to exterior walls in order to create a finish which is both durable and aesthetically pleasing. While the stucco, or whatever finish system is being used, may be generally impervious to water, the areas of transition around windows and doors provide vulnerable points for unwanted entry of water and moisture. Moisture and water intrusion is a significant cause of damage to the exterior face(s) of buildings and such structures. Indeed, building codes generally require an expansion joint and sealant, or similar mechanism, be installed at the interface of dissimilar materials on exterior walls in order to prevent such problems.

Casing beads of PVC construction are often used for perimeter sealant applications around doors and windows. The casing bead must be installed in such a manner to achieve the desired spacing between the casing bead and the door or window and to consistently maintain such spacing along the entire perimeter of the door or window. Once the bead is installed and the stucco or finish brought up to the bead, a backing rod is traditionally installed by hand within the channel between the edge of the casing bead and the window or door. These tasks are performed by an installer in the field.

Installation of the separate backing rod requires an investment of additional time and effort on the part of the installer. Moreover, there is always variance between installers as to whether the desired space is maintained around the whole window or door and, further, whether the backing rod is inserted to the desired depth around the entire window or door.

Object of the Invention

It is a goal of the invention to provide an improved casing bead which provides superior water management in stucco, stone veneer, and similar finishing applications in construction.

It is a further goal of the invention to provide an improved casing bead which can be more easily used in the field and reduces installation time and labor.

SUMMARY OF THE INVENTION

The present invention describes a casing bead having an integrated moisture seal. The casing bead of the invention is to be installed adjacent to the frame of a window or the jamb of a door at the termination point of plaster, stucco, or stone veneer. The casing bead prevents moisture from entering the area around the doors, windows, and other locations which transition between dissimilar claddings.

In the preferred embodiment, the invention comprises a specialized rubber gasket integrated with a traditional PVC casing bead. The rubber gasket is removably secured to the casing bead body via an interlocking rail arrangement. The rubber gasket further includes a tail to further enhance the water-resistant properties of the invention. Finally, the particular color of the rubber gasket facilitates inspection of the installation upon completion. The novel features of the casing bead substantially enhance its performance while reducing installation time.

DETAILED DESCRIPTION

Figure 1:
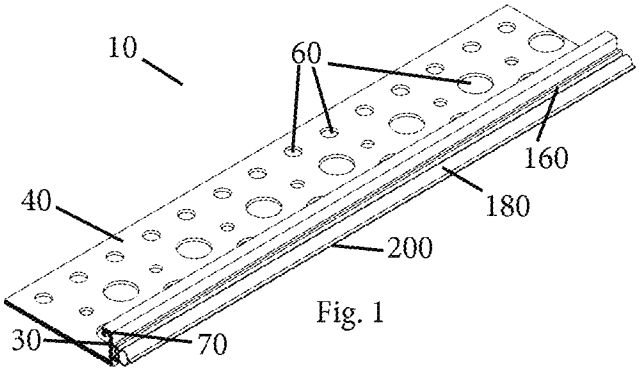
FIG. 1 is perspective view of the casing bead disclosed herein.

The present invention is a casing bead 10 having enhanced water and moisture prevention characteristics. In the preferred embodiment shown in FIGS. 1-2, the casing bead 10 has a generally J-shaped body 20, a bead wall 30, and a perforated flange 40 extending orthogonally from a first end 50 of said bead wall 30. The perforated flange 40 has a plurality of holes 60 located along its length. The second end 70 of the bead wall 30 has an extension 80 which first extends orthogonally from the end of the bead wall for a short distance and then turns at substantially a right angle and extends in a perpendicular direction toward the perforated flange 40. 09) The casing bead 10 further includes a mounting structure 90 for attachment of a rubber insert 100. The mounting structure 90 comprises a first wall 110 extending perpendicular from the bead wall 30 and terminating in a t-shaped projection 120 and a second wall 130 extending perpendicular from the bead wall and having a further extension 140 on the opposite end thereby forming a generally L-like shape. A moisture removal channel 160 is defined by the upper portion of the first wall 110 of the mounting structure 90 and the bead wall 30.

Figure 2:
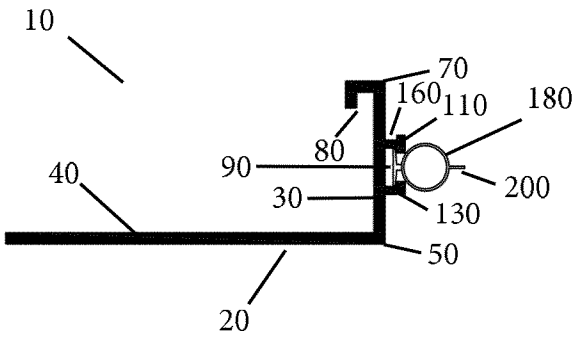
FIG. 2 is side view of the casing bead disclosed herein.

As seen in FIG. 2, the space defined by the first and second sides 110, 130 of the mounting structure 90 forms a mounting channel 170. A rubber insert 100 is removably secured within the mounting channel 170. The rubber insert 100 comprises a gasket 180, t-shaped mounting rail 190, and tail 200. The rubber insert 100 runs the length of the casing bead body 20.

In the preferred embodiment, the body 20 of the casing bead 10 is composed of polyvinyl chloride (PVC). The body 20 is fairly rigid in nature due to its PVC construction. The gasket portion 180 of the rubber insert 100 is a rubber or rubberized product which is more flexible than the body 20. Further, in the preferred embodiment, the gasket 180 is colored red. The gasket may be colored any bright color that is not similar to the color(s) of sealants traditionally used in the construction industry, e.g., the gasket would not be black, white, beige, gray, or any variation of such colors.

The casing bead body 20 and rubber gasket 180 are manufactured independently as two separate components and then combined. The rubber insert 100 is approximately the same length as the casing bead body 20. The rubber insert 100 is removably secured to the casing bead body 20 by sliding the mounting rail 190 of the rubber insert 100 into and along the mounting channel 170. The flanges 210, 220 on the mounting rail 190 remain in contact with a portion of the first and second walls of the mounting structure 90 as illustrated in FIG. 2. The rubber insert 100 is attached to the casing bead body 20, as shown in FIG. 1. In the preferred embodiment, the contact between the insert 100 and the mounting structure 90 is sufficient maintain the position of the insert 100 and no additional steps are taken to secure the rubber insert 100 to the casing bead body 20. Eliminating the need for additional steps to secure the insert reduces the manufacturing/production time of the product. However, it will be noted that in alternate embodiments, the rubber insert 100 may be further secured in place by either crimping the ends 230, 240 of the mounting channel or sodering or otherwise melting, the ends 230, 240 together or through the use of a similar mechanism. The casing bead 10 is manufactured and assembled prior to transport to the field for installation.

Figure 3:
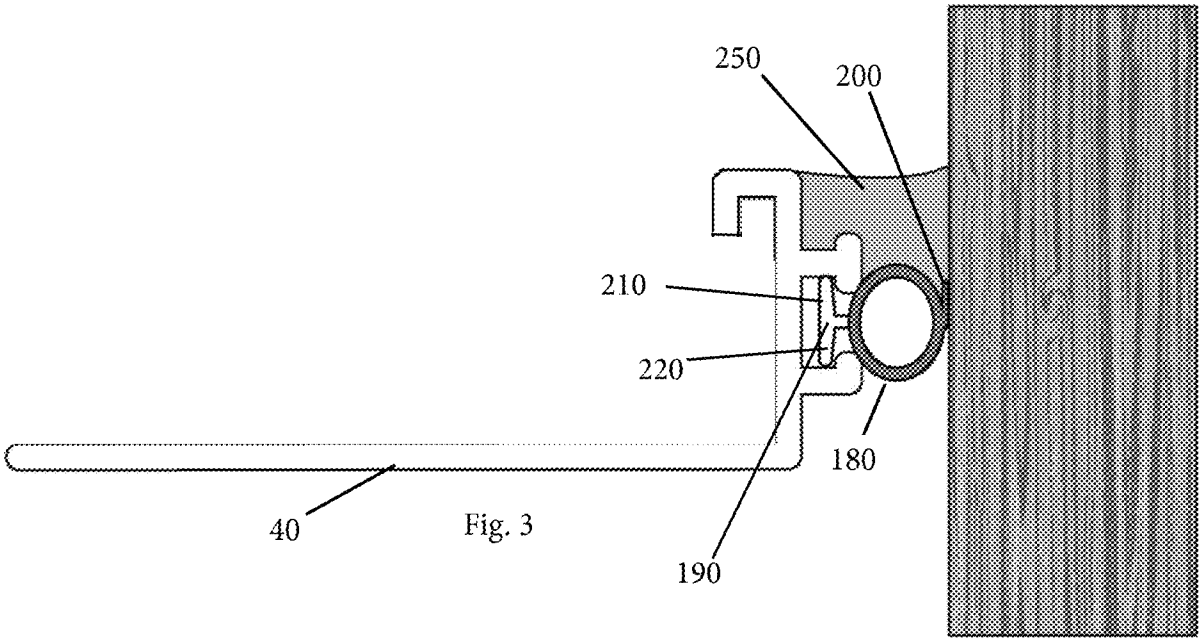
FIG. 3 is view of the casing bead from above when in use.

Referring now to FIG. 3, in operation, the casing bead 10 is positioned at a location where stucco, veneer, or other such finishing system, transitions to a door or window. The gasket 180 abuts the door or window jamb or frame when installed. The use of the rubber insert provides a uniformly spaced gap around the window or door. As the result of the pressure during installation, the flexible tail 200 bends or flexes such that once installed the tail projects away from the exterior wall as seen in FIG. 3. The tail 200 creates a secondary water seal to further prevent the intrusion of water and moisture.

Once the casing bead 10 has been installed, then caulk 250 is applied to the channel, over the rubber insert 100, to seal the gap/channel 260. Due to the fact that the rubber insert 100 is colored red, and the caulk or sealant used is customarily some shade of white, beige, or gray, an installer is provided with a quick visual reference guide to confirm the adequacy of caulk or sealant coverage within the gap/channel.

When the casing bead 10 is installed in a vertical position, i.e., the long axis of the casing bead 10 runs from floor to ceiling, the moisture removal channel 160 directs any transient water or moisture which finds its way behind the sealant down in a downward direction away from the bead 10. This redundant feature further improves the moisture and water elimination properties of the casing bead.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A casing bead comprising:

a body; said body comprising a bead wall, a perforated flange extending orthogonally from said bead wall, a mounting housing formed by a first projection and second projection which extend from said bead wall in a direction opposite said perforated flange wherein said first projection is generally t-shaped and comprised of a first section essentially parallel to said bead wall and a second section essentially perpendicular to said bead wall, and a mounting channel defined by said first and second projections;

a moisture seal gasket having a t-rail attached on one side of said moisture seal wherein said moisture seal is secured to said body via an interconnection of said t-rail and said mounting channel;

and, a longitudinal moisture removal channel defined by at least a portion of said first and second sections of said t-shaped first projection and at least a portion of said bead wall.

* * * * *